US008262850B2

(12) United States Patent
Tan et al.

(10) Patent No.: US 8,262,850 B2
(45) **Date of Patent: *Sep. 11, 2012**

(54) CHEMICAL ACTIVATION AND REFINING OF SOUTHERN PINE KRAFT FIBERS

(75) Inventors: Zheng Tan, Mason, OH (US); Xuan Nguyen, Cincinnati, OH (US); Karen L. Maurer, Liberty Township, OH (US)

(73) Assignee: International Paper Company, Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/668,387

(22) Filed: Sep. 23, 2003

(65) Prior Publication Data

US 2005/0061455 A1 Mar. 24, 2005

(51) Int. Cl.
*D21C 9/16* (2006.01)

(52) U.S. Cl. ..... 162/9; 162/24; 162/26; 162/78; 162/79; 162/82; 162/85; 241/21

(58) Field of Classification Search ..... 162/24–26, 162/28, 78–79, 149, 9, 82, 85; 8/116.1, 119; 241/20–21

See application file for complete search history.

(56) References Cited

U.S. PATENT DOCUMENTS

| | | | | |
|---|---|---|---|---|
| 1,298,552 | A | 3/1919 | Ornstein | |
| 1,298,553 | A | 3/1919 | Ornstein | |
| 1,298,554 | A | 3/1919 | Ornstein | |
| 1,860,431 | A | 5/1932 | Richter | |
| 2,178,696 | A | 11/1939 | Muskat et al. | |
| 2,212,338 | A | 8/1940 | Bown | |
| 2,368,527 | A | 1/1945 | Edelstien | |
| 2,512,338 | A | 6/1950 | Klug et al. | |
| 2,975,169 | A | 3/1961 | Cranford et al. | |
| 3,308,012 | A | 3/1967 | Tobar | |
| 3,707,148 | A | 12/1972 | Bryce | |
| 4,022,965 | A | 5/1977 | Goheen et al. | |
| 4,222,819 | A | 9/1980 | Fossum et al. | |
| 4,270,976 | A | 6/1981 | Sandstrom et al. | |
| 4,410,397 | A | 10/1983 | Kempf | |
| 4,427,490 | A | 1/1984 | Eckert | |
| 4,444,621 | A | 4/1984 | Lindahl | |
| 4,454,005 | A | 6/1984 | Stofko et al. | |
| 4,599,138 | A * | 7/1986 | Lindahl | 162/19 |
| 4,614,646 | A | 9/1986 | Christiansen | |
| 4,661,205 | A | 4/1987 | Ow et al. | |
| 4,756,799 | A | 7/1988 | Bengtsson et al. | |
| 4,783,239 | A | 11/1988 | Rich | |
| 4,869,783 | A | 9/1989 | Prusas et al. | |
| 4,875,974 | A | 10/1989 | Rich | |
| 4,889,595 | A | 12/1989 | Herron et al. | |
| 5,002,635 | A | 3/1991 | Gentile, Jr. et al. | |
| 5,296,099 | A | 3/1994 | Griggs et al. | |
| 5,300,358 | A | 4/1994 | Evers | |
| 5,383,964 | A | 1/1995 | Suc et al. | |
| 5,447,602 | A | 9/1995 | Sajbel et al. | |
| 5,460,924 | A * | 10/1995 | Buchanan et al. | 430/393 |
| 5,529,662 | A * | 6/1996 | Tan et al. | 162/65 |
| 5,536,625 | A * | 7/1996 | Buchanan et al. | 430/393 |
| 5,552,019 | A * | 9/1996 | Weinstock et al. | 162/79 |
| 5,607,546 | A | 3/1997 | Hoglund et al. | |
| 5,766,159 | A | 6/1998 | Martin et al. | |
| 5,863,389 | A | 1/1999 | White et al. | |
| 6,063,982 | A | 5/2000 | Martin et al. | |
| 6,214,164 | B1 * | 4/2001 | Rantala | 162/25 |
| 6,258,207 | B1 * | 7/2001 | Pan | 162/27 |
| 6,302,997 | B1 | 10/2001 | Hurter et al. | |
| 6,306,253 | B2 * | 10/2001 | Henricson | 162/65 |
| 6,368,456 | B1 | 4/2002 | Cimecioglu et al. | |
| 6,379,494 | B1 | 4/2002 | Jewell et al. | |
| 6,398,908 | B1 | 6/2002 | Hermansson et al. | |
| 6,436,238 | B1 * | 8/2002 | Pitkanen et al. | 162/182 |

(Continued)

FOREIGN PATENT DOCUMENTS

CA 1129161 8/1982

(Continued)

OTHER PUBLICATIONS

G. A. Smook "Handbook for Pulp & Paper Technologist," 1992, Angus Wilde Publications, 2nd Edition, pp. 194-208.*

Sun et al. Abstract of "The effect of metal ions on the reaction of hydrogen peroxide with Kraft lignin model compounds;" 1999, Can. J. Chem, vol. 77(5-6, pp. 667-675.*

Leporini et al. in "Hydrogen Peroxide in Chemical Pulp Bleaching—an overview-;" 2002; Congreso Iberoamericano de Invesigacion en cellulosa y Papel; CIADICYP; pp. 1-27.*

Rahmawati et al. in "Pulp bleaching by hydrogen peroxide activated with copper 2,2_-dipyridylamine and 4-aminopyridine complexes;" 2005, Chemical Engineering Journal, vol. 112, pp. 167-171.*

Ruuttunen et al. in "Concomitant Usage of Transition Metal Polyanions As Catalysts in Oxygen Delignification: Laboratory Bleaching Trials;" 2006, Appita Journal, pp. 1-14.*

Kubelka et al., "Delignification with Acidid Hydrogen Peroxide Activated by Molybdate," May 1992, Journal of Pulp and Paper Science, vol. 18, No. 3, pp. J108-J114.*

Qian, Y; Goodell, B.; Genco, J.M., (2002): Journal of Wood Chemistry and Technology, vol. 22, No. 4, pp. 267-284, 2002.

Zeronian et al., Bleaching of cellulose by hydrogen peroxide, 1995, Cellulose, p. 265-272, whole document.

Lenntech, http://www.lentech.com/Fenton-reaction.htm [downloaded from www.archive.org], Jun. 28, 2003 [downloaded on Jun. 19, 2008], whole document.

(Continued)

*Primary Examiner* — Jose A Fortuna

(74) *Attorney, Agent, or Firm* — Thomas W. Barnes, III; Eric W. Guttag; Richard C. Stewart, II

(57) ABSTRACT

A method for alteration of the morphology of cellulose fibers, particularly softwood fibers, by (a) subjecting the fibers to a metal ion-activated peroxide treatment carried out at a pH of between about 1 and about 9, preferably between 3 and 7, and (b) subjecting the treated fibers to a refining treatment thereby converts SW fibers to HW-like fibers in many respects. The metal ion-activated peroxide treatment has been noted to act on pulp cellulose and hemi-cellulose, causing oxidation and oxidative degradation of cellulose fibers. The chemical treatment of the pulp, taken alone, is not sufficient to attain the desired modification of the morphology of the fibers, however, subsequent refining or like mechanical treatment of the chemically-treated fibers to achieve a given degree of refinement of the fibers requires dramatically less refining energy to achieve a desired end point of refinement and to impart other desirable properties to the pulp. A pulp of modified SW fibers and a mixture of HW fibers and modified HW fibers are disclosed.

21 Claims, 9 Drawing Sheets

U.S. PATENT DOCUMENTS

| | | | | |
|---|---|---|---|---|
| 6,458,245 | B1 | 10/2002 | Hoglund et al. | |
| 6,514,380 | B1 * | 2/2003 | Laine et al. | 162/52 |
| 6,562,195 | B2 | 5/2003 | Cimecioglu et al. | |
| 6,605,350 | B1 | 8/2003 | Sealey et al. | |
| 6,632,328 | B2 * | 10/2003 | Wan et al. | 162/78 |
| 6,635,755 | B1 | 10/2003 | Jaschinski et al. | |
| 6,695,950 | B1 | 2/2004 | Cimecioglu et al. | |
| 6,699,358 | B1 * | 3/2004 | Evans et al. | 162/65 |
| 6,743,332 | B2 * | 6/2004 | Haynes et al. | 162/78 |
| 6,765,042 | B1 | 7/2004 | Thornton et al. | |
| 6,770,168 | B1 | 8/2004 | Stigsson | |
| 6,773,552 | B1 | 8/2004 | Albert et al. | |
| 6,824,645 | B2 | 11/2004 | Jaschinski et al. | |
| 6,852,904 | B2 | 2/2005 | Sun et al. | |
| 6,881,299 | B2 * | 4/2005 | Parrish et al. | 162/78 |
| 6,923,889 | B2 | 8/2005 | Huuskonen et al. | |
| 7,094,317 | B2 * | 8/2006 | Lundberg et al. | 162/90 |
| 7,279,071 | B2 | 10/2007 | Williams et al. | |
| 7,326,317 | B2 * | 2/2008 | Westermark et al. | 162/13 |
| 7,520,958 | B2 | 4/2009 | Tan et al. | |
| 8,007,635 | B2 | 8/2011 | Tan et al. | |
| 2001/0028955 | A1 | 10/2001 | Luo et al. | |
| 2001/0050153 | A1 | 12/2001 | Wajer et al. | |
| 2002/0005262 | A1 | 1/2002 | Cimecioglu et al. | |
| 2002/0144796 | A1 * | 10/2002 | Wan et al. | 162/78 |
| 2002/0165110 | A1 | 11/2002 | Reinhardt et al. | |
| 2003/0019596 | A1 * | 1/2003 | Ragauskas et al. | 162/72 |
| 2003/0026828 | A1 | 2/2003 | Besemer et al. | |
| 2004/0154761 | A1 * | 8/2004 | Duggirala et al. | 162/24 |
| 2004/0154765 | A1 | 8/2004 | Huuskonen et al. | |
| 2005/0061455 | A1 * | 3/2005 | Tan et al. | 162/9 |
| 2006/0144535 | A1 * | 7/2006 | Nguyen et al. | 162/103 |
| 2006/0260773 | A1 * | 11/2006 | Tan et al. | 162/70 |
| 2007/0000627 | A1 * | 1/2007 | Tan et al. | 162/30.11 |
| 2007/0051481 | A1 * | 3/2007 | Tan et al. | 162/17 |
| 2007/0119556 | A1 * | 5/2007 | Tan et al. | 162/9 |
| 2007/0143932 | A1 * | 6/2007 | Buchert et al. | 8/116.1 |
| 2007/0163735 | A1 * | 7/2007 | Buchert et al. | 162/9 |
| 2008/0294132 | A1 | 11/2008 | Tan et al. | |
| 2009/0054863 | A1 * | 2/2009 | Tan et al. | 604/378 |
| 2009/0165968 | A1 | 7/2009 | Tan et al. | |
| 2011/0287275 | A1 | 11/2011 | Tan et al. | |

FOREIGN PATENT DOCUMENTS

| | | | |
|---|---|---|---|
| CA | 1190360 | | 7/1985 |
| DE | 10123665 | | 11/2002 |
| EP | 1077285 | | 2/2001 |
| EP | 1156065 | | 11/2001 |
| EP | 1245722 | | 10/2002 |
| EP | 1862587 | | 12/2007 |
| EP | 1862587 | A2 * | 12/2007 |
| FR | 2688787 | | 9/1993 |
| GB | 555985 | | 9/1943 |
| JP | 58054089 | | 3/1983 |
| JP | 2001115389 | | 4/2001 |
| JP | 2002026701 | | 1/2003 |
| RU | 2268327 | | 5/2005 |
| WO | 95/35408 | | 12/1995 |
| WO | WO 9722749 | A1 * | 6/1997 |
| WO | WO02/095129 | | 11/2002 |
| WO | 03042451 | | 5/2003 |
| WO | WO 03042451 | A2 * | 5/2003 |
| WO | WO2005/028744 | | 3/2005 |
| WO | WO 2005028744 | A1 * | 3/2005 |
| WO | WO2006/119392 | | 11/2006 |
| WO | WO2006/127880 | | 11/2006 |

OTHER PUBLICATIONS

Shenai, Studies in Chemically Modified Celluloses. IX. Oxidation of Cellulose in the Presence of Chelating Agents, 1976, Journal of Applied Polymer Science, vol. 20, whole document.

Smook, Handbook for Pulp and Paper Technologists, 1992, Angus Wilde Publications, 2nd edition, p. 228.

Gullichsen et al., Chemical Pulping 6A, 1999, Fapet Oy, p. A207 and A653.

Fibersource, Cellulose [downloaded online from http://www.fibersource.com/F-TUTOR/cellulose.htm], downloaded on Jan. 16, 2010, Fibersource, whole document.

Burgess, Relationship Between Colour Production in Cellulose and the Chemical Changes Brought About by Bleaching, 1982, The American Institute for Conservation, vol. 1, whole document.

Effect and Control of Transition Metal Ions During Peracid Bleaching, South China University of Technology, Guangzhou, 510640.

* cited by examiner

CHEMICAL ACTIVATION AND REFINING OF SOUTHERN PINE KRAFT FIBERS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to papermaking and particularly to the treatment of cellulosic material preparatory to use of the treated material to manufacture paper web material.

As is well known in the art, paper is commonly formed from wood. Generally, the industry divides wood used in papermaking into two categories; namely hardwoods and softwoods. Softwood fibers (tracheids) come from needle-bearing conifer trees such as pine, spruce, alpine fir, and Douglas fir. Hardwood fibers are derived from deciduous trees of various varieties.

Among the distinguishing differences between hardwood (HW) fibers and softwood (SW) fibers are (a) the length of the individual cellulosic fibers of the wood, (b) the coarseness of the fibers, and (c) the stiffness or collapsibility of the fibers.

The morphology of softwood fibers, tends to limit the potential uses of the papers producible from such fibers. "Paper" as used herein includes webs or sheets without limitation as to the size or basis weight of the web or sheet. For example, either HW or SW paper may be employed as "bleached board" (useful in containers for consumer products, for example) or as "container board" or "liner board" (useful in corrugated boxes, for example). Printability of a paper is a major consideration with respect to the end use of the paper. SW fibers are notoriously problematic as respects the printability of the paper produced from these fibers in that SW fiber papers tend to be inordinately porous, stiff, and must be treated specially to obtain a paper surface which is suitably printable.

It is well known in the art that HW and SW must be subjected to specific treatments for converting the wood into a fibrous slurry employed in the formation of a paper web. Softwoods are more plentiful and are more readily replaceable, as by tree farming. Softwoods in general are less costly. Thus, it is desirable that SW fibers be substituted for HW fibers wherever possible in papermaking. Southern pine, or mixtures of hardwoods and softwoods, are commonly examined as possible substitutes for end products which have heretofore been manufactured using hardwoods.

Heretofore, in attempts to utilize SW fibers in printable paper, it has been proposed to treat the pulped fibers with hydrolytic enzymes. Refining of the enzyme-treated fibers to alter their size, shape, degree of fibrillation, etc., have been employed. Enzyme treatments suffer from sensitivities of the enzyme to process conditions, and a tendency to become inactivated and/or to be carried forward into the papermaking equipment. The lack of cost-effectiveness has also been a long-standing issue.

Chemical treatments, such as hydrogen peroxide treatment, are commonly carried out under alkaline conditions for bleaching or brightening of wood pulps. This condition that is maximized for bleaching, usually does not correlate with the best conditions for maximum oxidation.

Smoothness and Formation are measures of, among other things, the printability of the paper. "Formation", as used as a paper characteristic usually, and herein, is a synonym for relative uniformity over a scale of some distance, e.g., 5 to 20 mm. Formation may be judged by viewing it with light from the back and other means. Both smoothness and formation are affected, among other things, fiber length, morphology and collapsibility.

BRIEF SUMMARY OF THE INVENTION

In accordance with one aspect of the present invention, it has been found that alteration of the morphology of cellulose fibers, particularly softwood fibers, by (a) subjecting the fibers to a metal ion-activated peroxide treatment carried out at a pH of between about 1 and about 9, preferably between 3 and 7, and (b) subjecting the treated fibers to a refining treatment converts SW fibers to HW-like fibers in many respects. The metal ion-activated peroxide treatment has been noted to act on pulp cellulose and hemi-cellulose, causing oxidation and oxidative degradation of cellulose fibers. The chemical treatment of the pulp, taken alone, is not sufficient to attain the desired modification of the morphology of the fibers, however, subsequent refining or like mechanical treatment of the chemically-treated fibers to achieve a given degree of refinement of the fibers requires dramatically less refining energy, e.g., between about 30 and 50% less energy to achieve a desired end point of refinement. The pulp treated in accordance with the present invention demonstrates substantially reduced fiber length or fiber length distribution, thereby enabling better uniformity of paper sheet (web) structure as measured by formation or texture. Moreover, the treated fibers are more collapsible during sheet consolidation and result in significantly improved paper surface properties such as smoothness. In these respects, SW fibers treated in accordance with the present invention are substantially functionally equivalent to HW fibers in regards to their usefulness in papermaking. The treatment of the present invention may be applied to wood chemical pulps (or pulp mixtures) having various processing histories such as pulping, bleaching or acid hydrolysis, or other combinations of processing of wood into pulp suitable for infeed to a papermaking machine.

In one embodiment, the present invention may be applied to pulp which has already been subjected to refining, chemical treatment, enzyme treatment, microfibrilltion, and/or acid hydrolysis, for example, to increase the pulp freeness or improve drainage during the papermaking process and/or to reduce the cellulose particles suspension viscosity and improving flow characteristic.

In a further embodiment, the advantages of the present invention may be achieved employing a hypochlorite treatment at pH 3-9, preferably, pH 3-8 and employing hypochlorous acid as the dominate active agent, followed by subsequent refining of the treated pulp.

Moreover, either the metal ion-activated peroxide or the hypochlorous acid treatment may be applied alone to refined fibers for increased freeness/drainage, or on micro-fibrillated cellulose materials for reduced suspension viscosity. Further, either embodiment may be employed as a means for controlling the viscosity of a pulp suspension at any of various locations between the initial digestion of the cellulose material to and including the feeding of the pulp suspension into a papermaking machine. This latter aspect of the present invention is applicable in the dissolution of pulp for viscose production, for example. In certain stances, the beneficial effects of the present invention are exhibited in the calendaring of a paper web or sheet formed from treated SW fibers or combinations of HW fibers and treated SW fibers.

In a still further embodiment, the present invention may be combined with a fiber fractionation process for the treatment of specific fiber fractions.

Paper produced employing pulp treated in accordance with the present invention exhibits tear strengths at HW levels, with little material deterioration of tensile strength. Improved bonding of the fibers within the sheet is also provided due to enhanced freeness.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
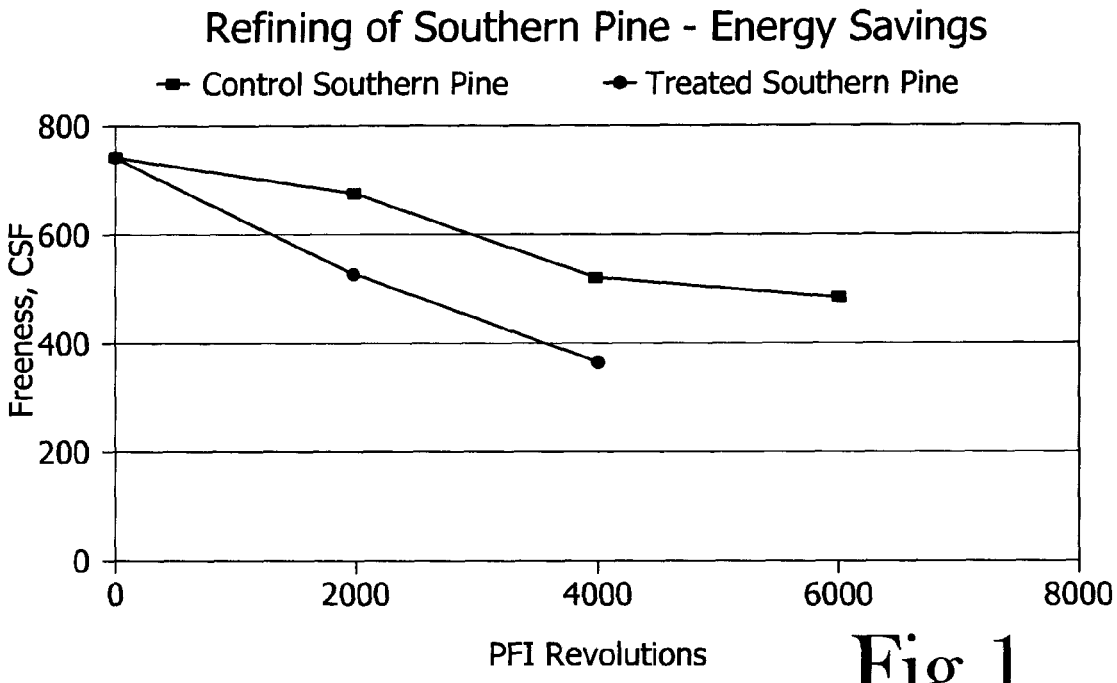
FIG. 1 is a graph depicting the energy savings attributable to the present invention when refining Southern Pine pulp.

In accordance with one aspect of the present invention, there is provided a method for the transformation of softwood fibers, particularly Southern pine fibers, into hardwood-like fibers. The method employs the steps of (a) subjecting a SW pulp containing cellulose and hemicellulose, to a solution containing a transitional metal ion and a peroxide at a pH of between about 1 and 9 for a time sufficient to oxidize a substantial portion of the cellulose/hemi-cellulose and to oxidatively degrade the cellulose fibers, and (b) subjecting the treated pulp to a refining operation. The pulp thus treated, when formed into a web on a papermaking machine exhibits many hardwood-like properties such as overall formability into a web having surface properties like webs formed from hardwood fibers employing conventional papermaking techniques.

In one embodiment of the present invention, softwood fibers obtained from coniferous trees, and particularly Southern pine trees, are converted into a pulp employing the kraft process in which the fibers are treated in a heated alkaline solution to substantially separate the fibers from their lignin binder, as is well known in the art. Whereas Southern pine fibers are particularly suitable for treatment employing the present invention, it is recognized that fibers from other coniferous trees may be employed. Further, the present invention may be advantageously employed with mixtures of SW and HW fibers, for example mixtures containing between about 50% and 90% by weight of SW pulp and between about 10% and 50% HW pulp.

The SW pulp or mixture of SW and HW pulps, prior to treatment thereof employing the present invention, may comprise pulp which has not undergone any conventional treatment of the pulp subsequent to the digestion step. However, the present invention is useful in treating pulps which, subsequent to digestion, have undergone substantially any of the commonly employed treatments of pulp such as an acid hydrolysis for removal of hexauronic acid, oxidation/bleaching employing oxygen and/or peroxide, or ozone, on the pulp and/or mechanical treatment of the pulp, ie., refining. In the most commonly contemplated process, the pulp or mixture of pulps, to be subjected to the method of the present invention will be a pulp(s) which has been digested and at least washed to remove black liquor.

In accordance with one aspect of the present invention, the pulp solution, at a temperature of between about 40 and 120 degrees C., is subjected to a solution of a transitional metal-activated peroxide for between about 10 and 600 minutes. In general, a higher treatment temperature will require less residence time, and vice versa. It is preferable that the treatment be done at 70-79 degrees C., with a residence time between 30-180 minutes. The treatment (either continuous or batch) can be carried out in a bleach tower, high-density tower, re-pulper tanks, or any suitable vessel with sufficient mixing and residence time.

In a preferred embodiment, and contrary to the conventional peroxide treatment of pulp wherein transitional metal ions are avoided or eliminated to avoid pulp damage or degradation by hydroxyl radicals, the treatment solution of the present invention, includes between about 0.2% and about 5% by wt. hydrogen peroxide and between about 0.002% and about 0.1% of a transitional metal ions, based on pulp. Iron (III) salts such as ferric chloride, or iron (II) salts such as ferrous sulfate and ferrous chloride, are especially useful as a source of the metal ions. Other metal ions, such as copper (II), cobalt(II) may be employed. In any event, as noted, only a trace of the transitional metal ions is required to achieve the advantageous results of the present invention, preferably between about 0.002% and about 0.01% of the metal ion.

Further contrary to conventional peroxide treatment of pulp wherein the peroxide treatment is carried out with the pulp at a very high pH for bleaching, in the present invention, the pulp treatment is carried out at a pH of between about 1 and about 9, preferably a pH between about 2 and 7.

Subjection of softwood pulp to the solution of the present invention at a temperature between about 40 C and about 120 C and at a pH between about 1 and about 9, has been found to cause oxidation and oxidative pulp degradation of the long, stiff and coarse kraft fibers. This chemical treatment of the fibers is followed by a mechanical treatment of the treated pulp, e.g., refining employing a conventional disc refiner, to cause fiber morphology change and paper property enhancement with respect to hardwood pulps. It will be understood by one skilled in the art that other mechanical treatment devices which provide equivalent refining of the pulp fibers may be employed.

Bleached southern pine Kraft pulp from International Paper-Augusta mill was treated at pH 4 with 1% hydrogen peroxide as based on pulp, with 0.01% Fe added as with ferric chloride. The treatment was conducted at the temperature of 80° C. for 1 hour. Both the treated and the control (untreated) pine pulps were refined with a PFI refiner. The data on PFI freeness and average fiber length are shown in Table I

TABLE I

| | PFI Revolutions | 0 Rev. | 2000 Revs. | 4000 Revs. | 6000 Revs |
|---|---|---|---|---|---|
| Control Southern Pine | Freeness | 739 CSF | 675 CSF | 522 CSF | 481 CSF |
| | Average Fiber Length, L(L) | 2.50 mm | 2.47 mm | 2.47 mm | 2.42 mm |
| Treated Southern Pine | Freeness | 746 CSF | 524 CSF | 364 CSF | — |
| | Average Fiber Length, L(L) | 2.37 mm | 1.84 mm | 1.64 mm | — |

As shown in FIG. 1, the results of refining revolution (indication of refining energy) vs. freeness development show that iron catalyzed hydrogen peroxide treatement of pulp enhances pulp refining considerably, resulting in substantial energy savings for reading the same freeness level.

Figure 2:
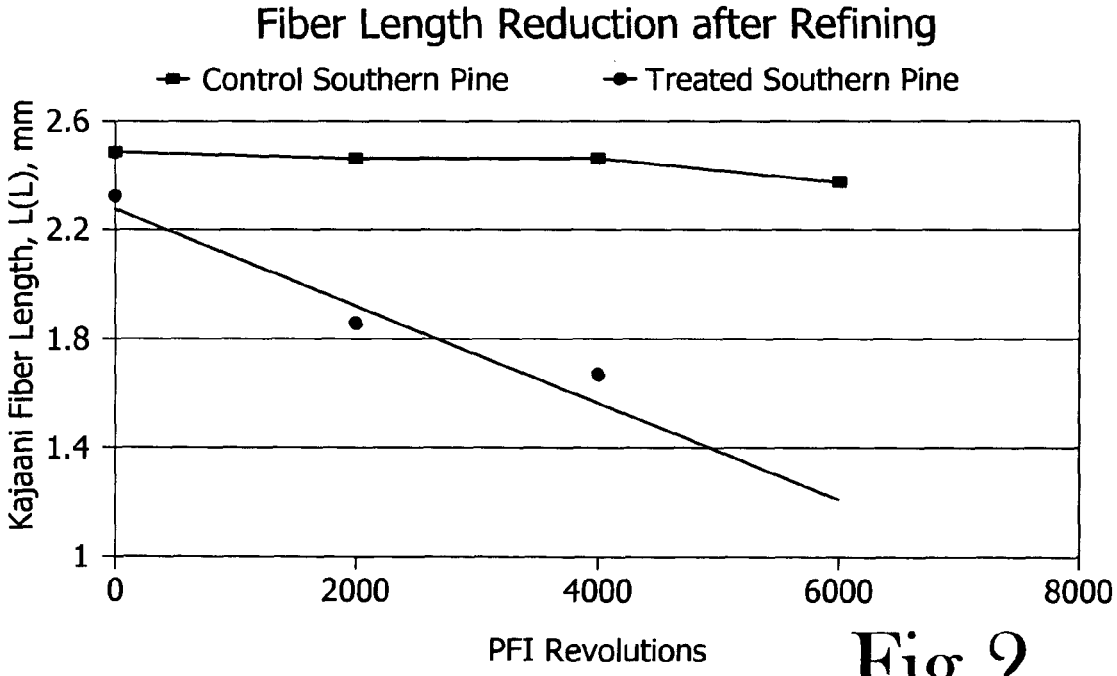
FIG. 2 is a graph depicting fiber length reduction achieved when treating Southern Pine pulp in accordance with the present invention.

FIG. 2 shows the fiber length reduction (length-weighted average) by refining and indicates that, with catalyzed hydrogen peroxide treatment before refining, the fiber length is substantially reduced after being subsequently refined. While for comparison, the untreated pulp (control) showed little fiber length reduction by PFI refining.

Figure 3:
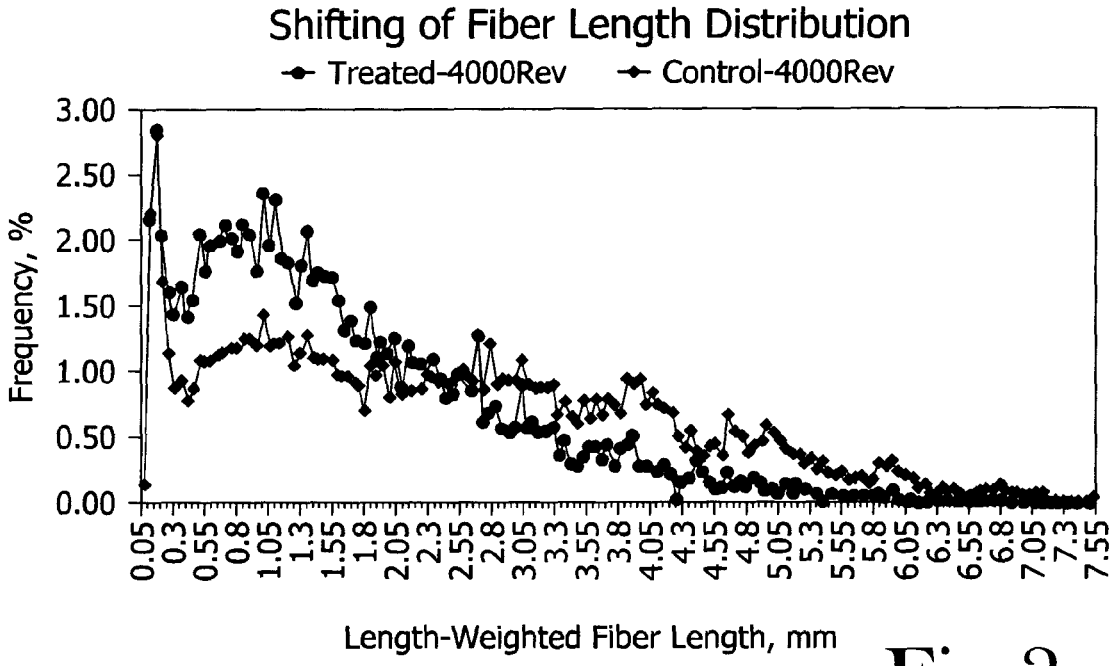
FIG. 3 is a graph depicting the shifting of fiber length distribution between treated and untreated softwood pulp in accordance with the present invention.

FIG. 3 further illustrates the fiber length reduction as shown in FIG. 2. In FIG. 3, there is demonstrated the fiber length distribution curves, with the treated vs. the untreated (control) southern pine, at the same refining. As seen, the treatment caused a significant shift of fiber length to shorter range than the control.

EXAMPLE 2

Bleached southern pine as employed in Example 1 was treated with 1% hydrogen peroxide based on pulp at pH 4, with 0.006% FE(II) as from ferrous sulfate. The treatment was carried out at the temperature of 70° C. for 1 hour. The treated pulp and control were PFI refined as in Example 1. TAPPI hand sheets were then made from these pulps.

Figure 4:
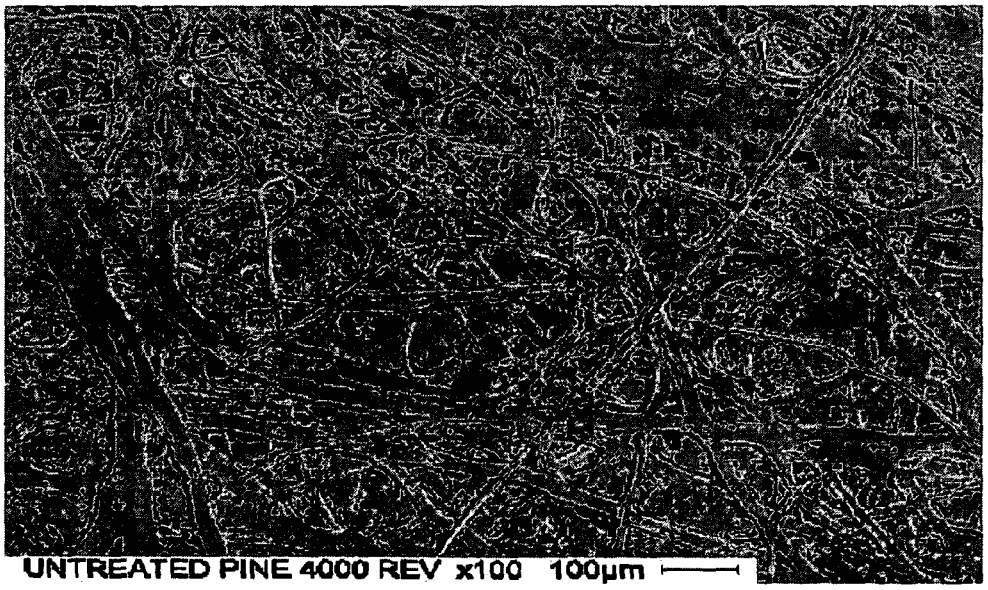
FIG. 4 is a microphotograph depicting untreated pine fibers.
Figure 5:
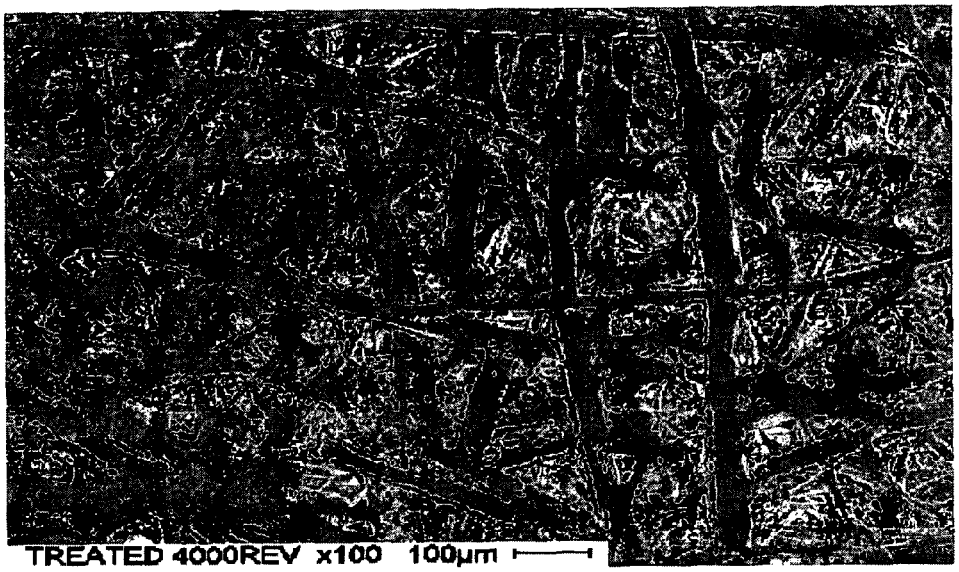
FIG. 5, is a microphotograph depicting pine fibers treated in accordance with the present invention.

To illustrate fiber morphology (beyond fiber length distributions) and fiber collapsibility, SEM (scanning electron microscopy) images were made of the hand sheet surface of treated vs. the control (untreated) softwood pulps, compared at 4000 Revs of PFI refining. These microphotographs are depicted in FIGS. 4 (untreated) (control) and 5 (treated) and demonstrate that the treated pine fibers are much more collapsed, or flattened, as compared to the fiber of the control. The collapsed and flattened fibers are desirable for making paper or paperboard with superior surface and printing properties. Some broken or cut fibers (fiber ends) can also be seen from the SEM of treated hand sheet, indicating fiber shortening.

EXAMPLE 3

Bleached southern pine pulp was treated with 1% hydrogen peroxide catalyzed by 0.006% Fe(II) at pH 4 as in the Example 2 above. The treated pulps were PFI refined, and made into hand sheets for paper physical property evaluations. Results are shown in Table II.

TABLE II

| | Basis Weight, g/m2 | Bulk, cc/g | Sheffield Smoothness | Tear Factor 100 * gf/g/m2 | Extensional Stiffness, lbs/in. |
|---|---|---|---|---|---|
| Treated Pine Pulp | | | | | |
| 730 CSF (Unrefined) | 151.9 | 1.90 | 375.6 | 190.9 | 2960 |
| 556 CSF | 155.2 | 1.34 | 165.3 | 111.9 | 4780 |
| 421 CSF | 154.4 | 1.36 | 127.2 | 103.4 | 5050 |
| 304 CSF | 155.2 | 1.26 | 129.7 | 98.1 | 5210 |
| Control Pine Pulp | | | | | |
| 740 CSF (Unrefined) | 162.4 | 1.91 | 380 | 270.9 | 3490 |
| 661 CSF | 155.6 | 1.40 | 249.6 | 193.6 | 4020 |
| 625 CSF | 159.9 | 1.35 | 185.3 | 188.7 | 4340 |
| 569 CSF | 158.5 | 1.31 | 191.6 | 167.4 | 4540 |
| 443 CSF | 155.9 | 1.27 | 157.8 | 170.2 | 4340 |
| Bleached Hardwood Pulp | | | | | |
| 615 CSF | 166 | 1.88 | 333 | 52.3 | 2040 |
| 584 CSF | 163.1 | 1.64 | 268.6 | 87.9 | 2520 |
| 544 CSF | 164.9 | 1.53 | 224.4 | 100 | 2840 |
| 507 CSF | 161.0 | 1.40 | 175.2 | 112.6 | 3030 |
| 462 CSF | 160.5 | 1.36 | 142.2 | 126.9 | 3010 |
| 427 CSF | 162.8 | 1.31 | 127.8 | 107.8 | 3480 |
| 362 CSF | 163.9 | 1.273 | 89 | 123.6 | 3320 |

Figure 6:
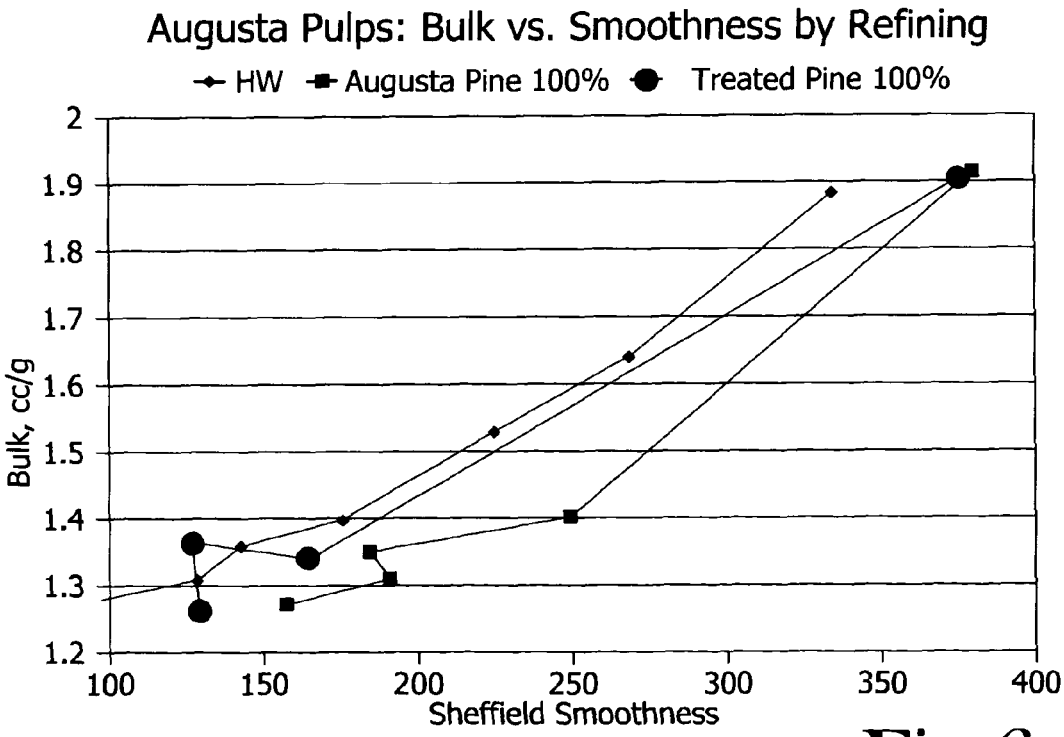
FIG. 6 is a graph depicting the relationship of bulk vs. smoothness of hardwood pulp, untreated pine pulp and treated pine pulp.
Figure 7:
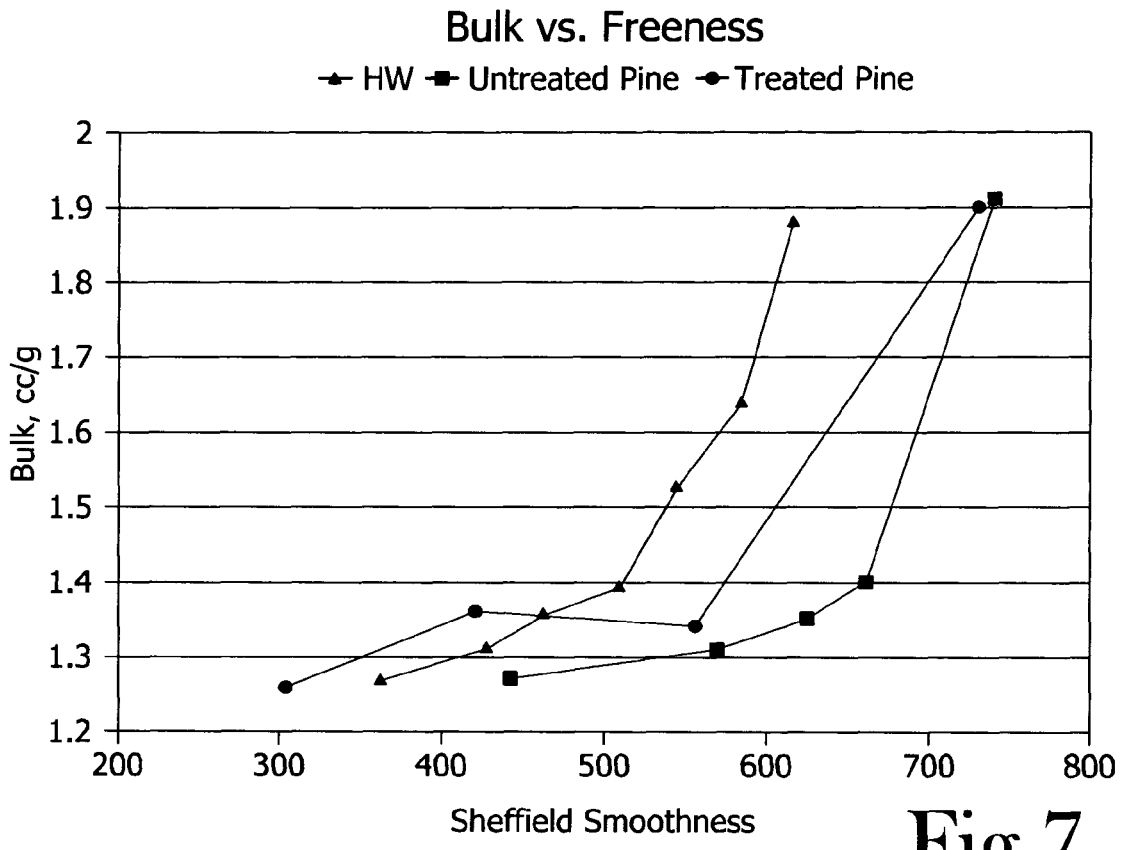
FIG. 7 is a graph depicting the relationship of bulk vs. freeness of the pulps depicted in FIG. 6.

From this table, it is noted that the treated pine, after refined to ~560 CSF or lower freeness (to shorten the fibers also), show improved bulk-smoothness. This is also shown in FIG. 6. FIG. 7 depicts the bulk at given freeness, which suggests the advantage of refining the treated pine to lower freeness, such as 400 CSF (depending on drainage or furnish mix requirements on paper machines).

Figure 8:
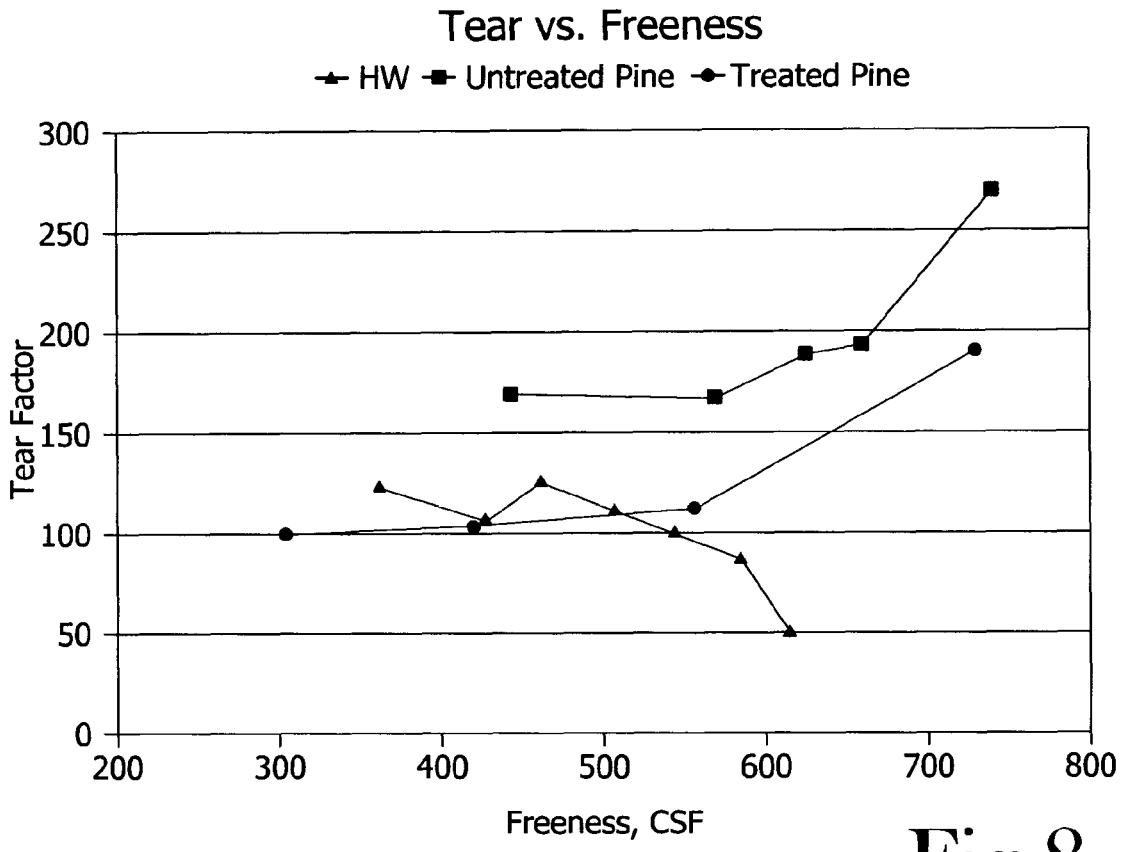
FIG. 8 is a graph depicting the relationship of tear vs. freeness of the pulps depicted in FIG. 6.

In terms of mechanical properties, the treatment impacted significantly the Tear strength, reducing it to the level of hardwood (FIG. 8). This is acceptable when using the treated pine fibers to replace hardwood fibers in a paper furnish. The reduction in Tear results from significant fiber length reduction, and the effect of chemistry.

Other mechanical properties were only slightly affected, and remain substantially higher than hardwood furnish. Interestingly, as shown in Table II, the elastic stiffness of treated pine can even be higher than that of the control pine.

EXAMPLE 4

The treated pine as in Example 3 above, refined to 560 CSF, was also mixed with hardwood pulp of a range of freeness, to investigate the mixed furnish paper properties such as bulk and smoothness. The results are listed in Table III.

TABLE III

| | Sheffield Smoothness | Bulk, cc/g |
|---|---|---|
| 10% Treated Pine (560 CSF) + 90% Hardwood | 323 | 1.83 |
| | 308 | 1.83 |
| | 171.2 | 1.37 |
| | 137.8 | 1.33 |
| 20% Treated Pine (560 CSF) + 80% Hardwood | 302 | 1.75 |
| | 231.8 | 1.5 |
| | 182.8 | 1.43 |
| | 136.6 | 1.32 |
| 50% Treated Pine (560 CSF) + 50% Hardwood | 318 | 1.79 |
| | 182.4 | 1.41 |
| | 163.4 | 1.38 |
| | 147.6 | 1.29 |

Figure 9:
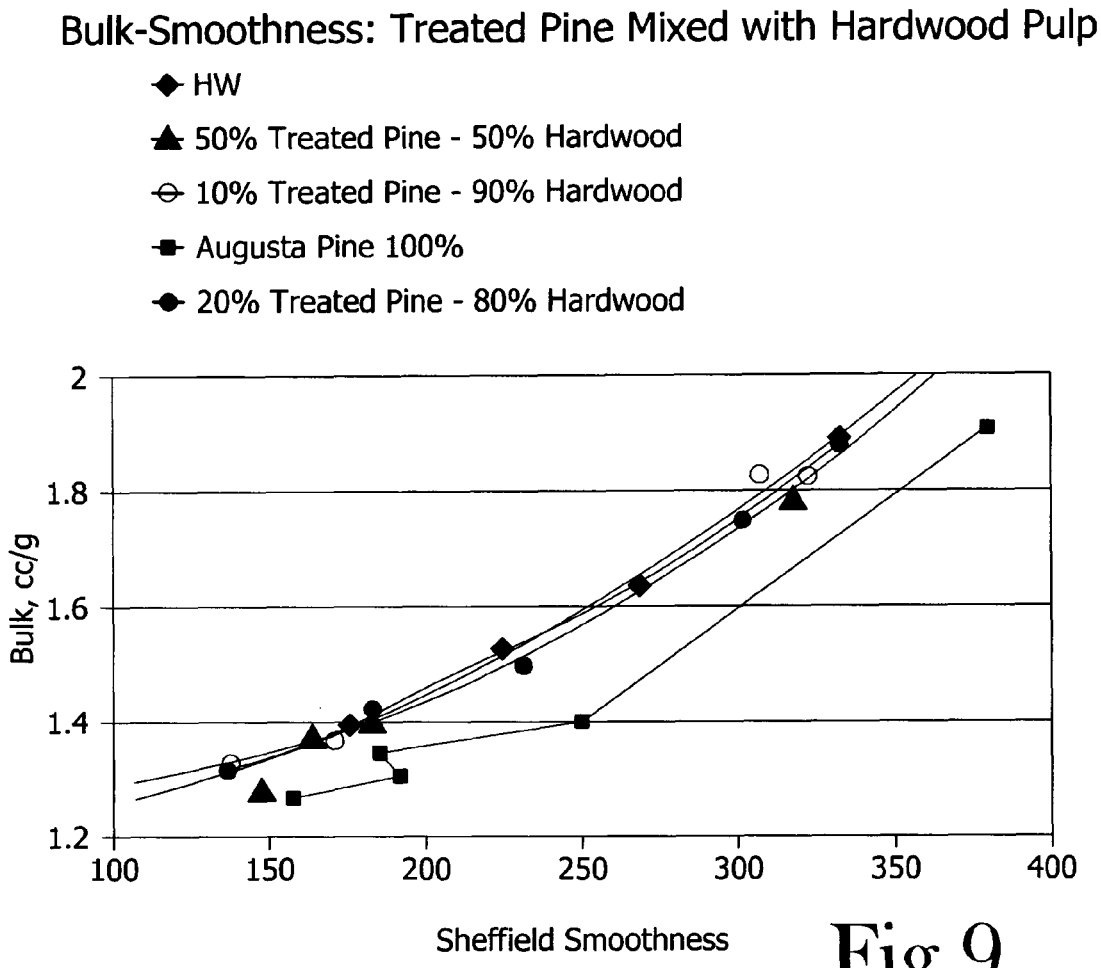
FIG. 9 is a graph depicting bulk and smoothness relationship of untreated hardwood pulp, untreated pine pulp, and various mixtures of hardwood and softwood pulps.

FIG. 9 plots the bulk-smoothness curve of the mixed pulp furnish (data from Table III), along with 100% pine and hardwood curves (data from Table II). It is obvious that the treated pine can be used to replace substantial amounts of hardwood pulp. The exact amount of hardwood replacement in the paper mill, however, may also be affected somewhat by the nature, type and optimization of commercial refiners.

EXAMPLE 5

Figure 10:
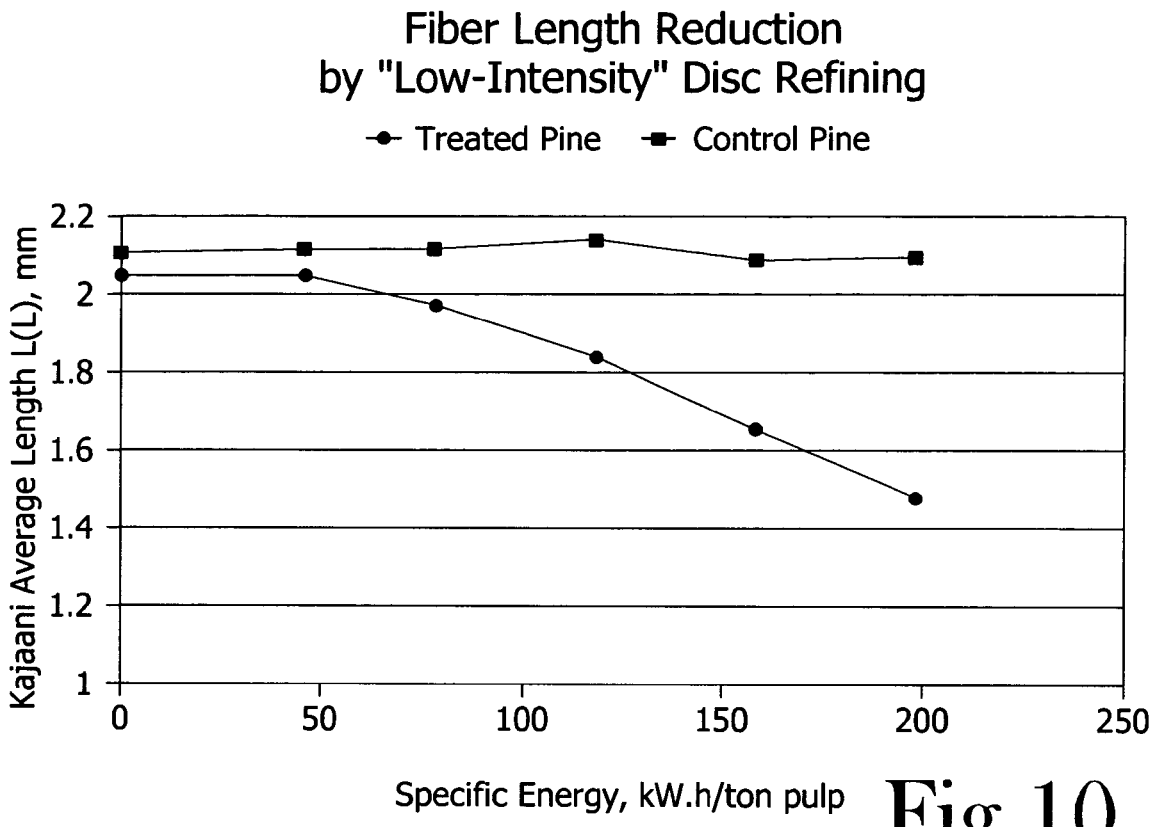
FIG. 10 is a graph depicting the fiber length reduction of untreated pine pulp and pulp treated in accordance with the present invention, employing low intensity disc refining.

A Voith LR1 Disc Refiner was used to refine bleached southern pine which 5 had been treated with 1% hydrogen peroxide, as catalyzed by Fe(III) at pH4. The refiner specific edge load was set at 0.8 Ws/m. As seen from Table IV, FIG. 10, energy saving and fiber length reduction were confirmed.

TABLE IV

| Refining | Treated Southern Pine | | Control Southern Pine | |
|---|---|---|---|---|
| Energy, kW · h/ ton pulp | Freeness | Kajaani average fiber length, L(L) | Freeness | Kajaani average fiber length, L(L) |
| 0 | 750 CSF | 2.07 mm | 750 CSF | 2.11 mm |
| 46 | 677 CSF | 2.05 mm | 722 CSF | 2.12 mm |
| 78 | 610 CSF | 1.98 mm | 677 CSF | 2.12 mm |
| 118 | 455 CSF | 1.84 mm | 633 CSF | 2.14 mm |

TABLE IV-continued

| Refining | Treated Southern Pine | | Control Southern Pine | |
|---|---|---|---|---|
| Energy, kW · h/ ton pulp | Freeness | Kajaani average fiber length, L(L) | Freeness | Kajaani average fiber length, L(L) |
| 158 | 317 CSF | 1.66 mm | 579 CSF | 2.09 mm |
| 198 | 197 CSF | 1.48 mm | 538 CSF | 2.10 mm |

EXAMPLE 6

A Voith LR1 Disc Refiner was used to refine bleached southern pine, which had been treated with 1% hydrogen peroxide, as catalyzed by Fe(II) at pH4. The refiner specific edge load was set at 4 km.

Figure 11:
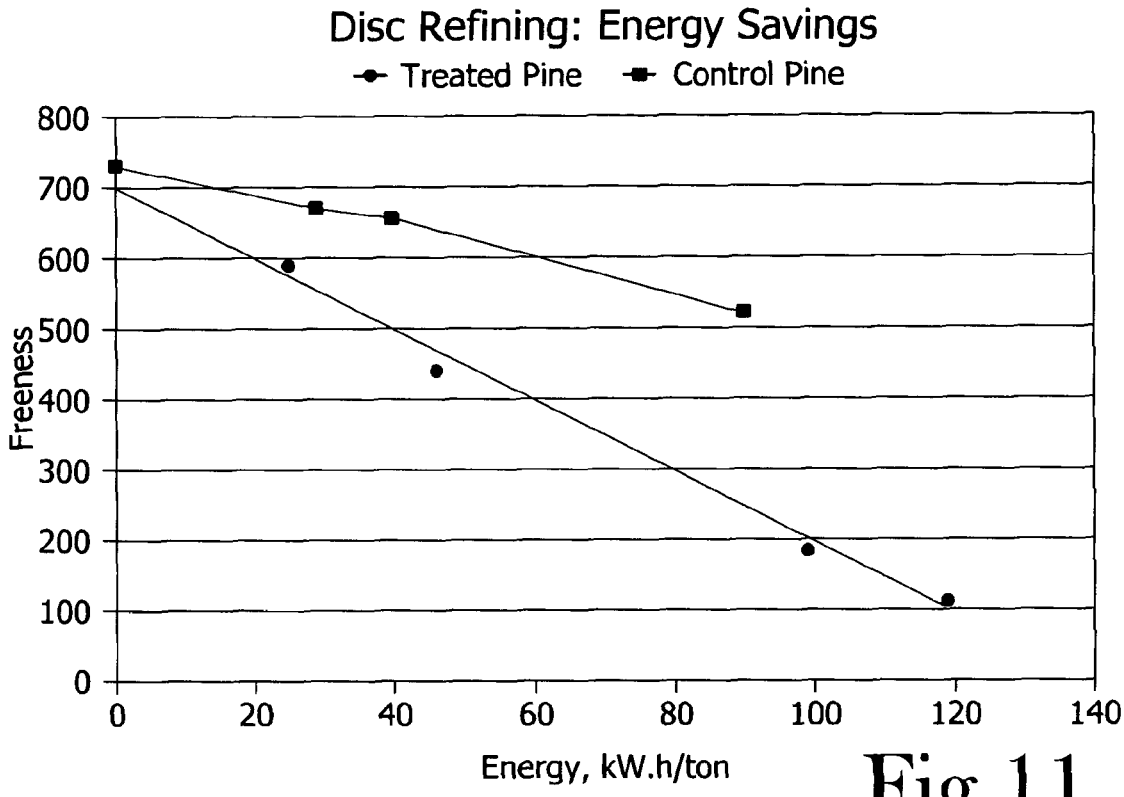
FIG. 11 is a graph depicting the energy savings associated with disc refining employed as a component of the present invention when processing treated and untreated pine pulp.
Figure 12:
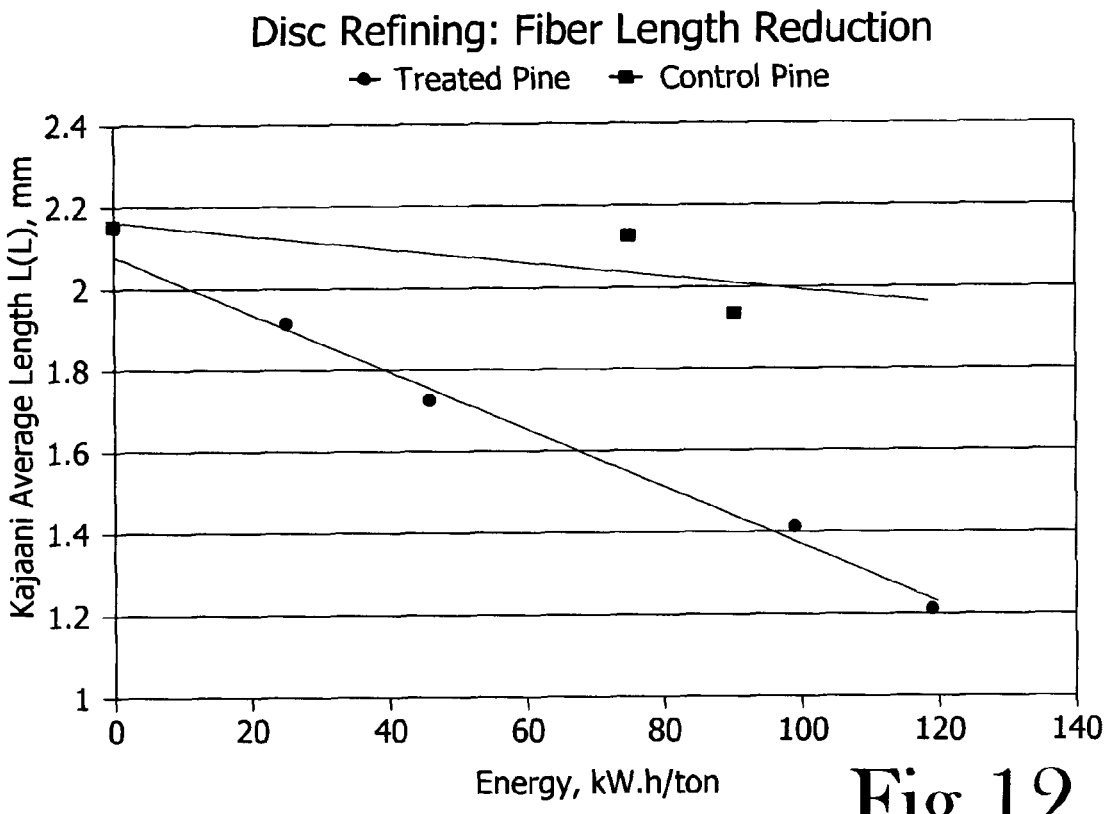
FIG. 12 is a graph depicting the relationship between fiber length reduction and the energy employed in refining untreated pulp and pulp treated in accordance with the present invention.

From Table V, FIGS. 11, 12, it is seen that energy saving and fiber length reduction were confirmed.

TABLE V

| Treated Southern Pine | | | | | |
|---|---|---|---|---|---|
| Refining Energy, kW · h/ton | 25 | 46 | 99 | 119 | — |
| Freeness | 590 CSF | 442 CSF | 185 CSF | 115 CSF | — |
| Kajaani average length L(L) | 1.9 mm | 1.72 mm | 1.4 mm | 1.2 mm | — |
| **Untreated Pine—Control** | | | | | |
| Refining Energy, KW · h/ton | 0 | 29 | 40 | 75 | 90 |
| Freeness | 730 CSF | 671 CSF | 657 CSF | — | 522 CSF |
| Kajaani average length L(L) | 2.14 mm | — | — | 2.12 | 1.93 |

What is claimed:

1. A method for modulating the morphology of softwood fibers comprising the steps of:

subjecting pulp containing softwood fibers to a solution containing ferrous (II) or ferric (III) metal ions at a concentration of from 0.002% to about 0.1% by weight based on pulp and a peroxide at a pH between about 2 and about 7 for a time of from about 10 minutes to about 10 hours at a temperature from about 40 to 120° C. to cause ferrous (II) or ferric (III) metal ion catalyzed oxidative degradation of cellulose of such peroxide treated softwood fibers, and directly refining the peroxide treated and oxidatively degraded fibers to form refined paper making fibers which exhibit a substantially shorter fiber length and distribution and enhanced fiber collapsibility compared to the unrefined paper making fibers, wherein said method reduces fiber suspension viscosity after said refining step.

2. The method of claim 1 wherein ferrous chloride, ferrous sulfate, or ferric chloride are a source of said ferrous (II) or ferric (III) metal ions.

3. The method of claim 1 wherein said pH is between about 3 and about 7.

4. The method of claim 3 wherein ferrous chloride, ferrous sulfate, or ferric chloride are a source of said ferrous (II or ferric (III) metal ions.

5. The method of Claim 1 wherein said peroxide is present in said solution at a concentration between about 0.2% and about 5% based on pulp.

6. The method of claim 1 wherein said softwood fibers are subjected to said solution for a time sufficient to substantially act on at least the cellulose and hemi-cellulose of the pulp, causing oxidation and oxidative degradation of cellulose fibers.

7. The method of claim 1 wherein said softwood fibers are Kraft fibers.

8. The method of claim 1 wherein said softwood fibers are Southern Pine fibers.

9. The method of claim 1 wherein said softwood fibers are bleached fibers.

10. The method of claim 1 wherein said softwood fibers are bleached Kraft fibers.

11. The method of claim 1 wherein said refined paper making fibers exhibit paper making properties substantially functionally equivalent to hardwood pulp papermaking properties.

12. The method of claim 1, wherein said pH is between about 3 an about 7.

13. The method according to claim 1 further comprising adding a source of ferrous (II) or ferric (III) metal ions to said peroxide.

14. The method according to claim 13, further comprising:

adding a source of ferrous (II) or ferric (III) metal ions to said peroxide in the presence of the pulp.

15. The method according to claim 14, further comprising:

adding between 0.002% and about 0.1% of ferrous (II) or ferric (III) ions based on pulp to said peroxide in the presence of the pulp.

16. The method according to claim 13, further comprising:

adding between 0.002% and about 0.1% of ferrous (II or ferric (III) metal ions based on pulp.

17. The method according to claim 1 wherein said pulp further comprises hardwood fibers.

18. A method for modulating the morphology of softwood fibers, comprising:

adding ferrous (II) or ferric (III) metal ions at a concentration of from 0.002% to about 0.1% by weight based on pulp to a solution comprising peroxide to form a metal-ion activated peroxide;

contacting pulp including softwood fibers with the metal ion-activated peroxide at a pH between about 2 and about 7 for a time of from about 10 minutes to about 10 hours at a temperature from about 40 to 120° C. to cause ferrous (II) or ferric (III) metal ion catalyzed oxidative degradation of cellulose of such peroxide treated softwood fibers; and directly refining the peroxide treated and oxidatively degraded fibers to form fibers having a modified morphology which exhibit a substantially shorter fiber length and distribution and enhanced fiber collapsibility compared to the unrefined fibers, wherein said method reduces fiber suspension viscosity after said refining step.

19. The method according to claim 18, wherein ferrous chloride, ferrous sulfate, or ferric chloride are a source of the ferrous (II) or ferric (III) metal ions.

20. The method according to claim 18, wherein said pH is between about 3 and about 7.

21. The method according to claim 18, wherein said pulp comprises between about 50% and about 90% softwood fibers and between about 10% and about 50% hardwood fibers.

* * * * *